US009862570B2

(12) United States Patent
Benosman et al.

(10) Patent No.: US 9,862,570 B2
(45) Date of Patent: Jan. 9, 2018

(54) CONTROLLING SWAY OF ELEVATOR CABLE CONNECTED TO ELEVATOR CAR

(71) Applicants: Mitsubishi Electric Research Laboratories, Inc., Cambridge, MA (US); Mitsubishi Electric Corporation, Chiyoda-ku, Tokyo (JP)

(72) Inventors: Mouhacine Benosman, Boston, MA (US); Daisuke Nakazawa, Tokyo (JP); Seiji Watanabe, Tokyo (JP); Daiki Fukui, Tokyo (JP)

(73) Assignees: Mitsubishi Electric Research Laboratories, Inc., Cambridge, MA (US); Misubishi Electric Corporation, Tokyo (JP)

( * ) Notice: Subject to any disclaimer, the term of this patent is extended or adjusted under 35 U.S.C. 154(b) by 0 days.

(21) Appl. No.: 15/066,102

(22) Filed: Mar. 10, 2016

(65) Prior Publication Data

US 2017/0260025 A1 Sep. 14, 2017

(51) Int. Cl.

| | |
|---|---|
| ***B66B 7/10*** | (2006.01) |
| ***B66B 1/28*** | (2006.01) |
| ***B66B 7/06*** | (2006.01) |
| ***B66B 1/34*** | (2006.01) |
| ***B66B 1/30*** | (2006.01) |
| ***B66B 9/00*** | (2006.01) |

(52) U.S. Cl.
CPC ..... *B66B 7/064* (2013.01); *B66B 1/30* (2013.01); *B66B 1/3492* (2013.01); *B66B 9/00* (2013.01)

(58) Field of Classification Search
USPC ..... 187/247
See application file for complete search history.

(56) References Cited

U.S. PATENT DOCUMENTS

| | | | | |
|---|---|---|---|---|
| 4,342,379 | A * | 8/1982 | Games | G05B 19/416 187/316 |
| 2014/0124300 | A1* | 5/2014 | Benosman | B66B 7/06 187/247 |
| 2015/0008075 | A1* | 1/2015 | Benosman | B66B 7/06 187/247 |
| 2015/0027814 | A1* | 1/2015 | Benosman | B66B 5/02 187/247 |

* cited by examiner

*Primary Examiner* — Christopher Uhlir
(74) *Attorney, Agent, or Firm* — Gene Vinokur; James McAleenan; Hironori Tsukamoto

(57) ABSTRACT

A method for controlling an operation of an elevator system is discloses. The elevator system includes an elevator car moving within an elevator shaft and at least one elevator cable connected to the elevator car and the elevator shaft to carry electrical signals to the elevator car. The method determines a counter force on the elevator cable required to change a nominal shape of the elevator cable to an inverse shape of a current shape of the elevator cable caused by disturbance on the elevator system and applies the counter force to the elevator cable.

9 Claims, 6 Drawing Sheets

CONTROLLING SWAY OF ELEVATOR CABLE CONNECTED TO ELEVATOR CAR

FIELD OF THE INVENTION

This invention relates generally to elevator systems, and more particularly to reducing a sway of an elevator cable in an elevator system.

BACKGROUND OF THE INVENTION

Typical elevator systems include an elevator car, e.g., for moving passengers between different floors of the building and a counterweight moving along guiderails in a vertical elevator shaft above or below ground. The car and the counterweight are connected to each other by hoist cables. The hoist cables are wrapped around a grooved sheave located in a machine room at the top or bottom of the elevator shaft. The sheave can be moved by an electrical motor, or the counterweight can be powered by a linear motor. Furthermore, the car receives control signals and power signals through a set of electrical cables which have one side attached to the bottom of the elevator car and the opposite side attached to the elevator shaft usually at the mid distance between the top and the bottom of the car.

The sway of the cables refers to an oscillation of the cables, e.g., electrical cables, in the elevator shaft. The oscillation can be a significant problem in an elevator system. The oscillation can be caused, for example, by wind induced building deflection and/or the vibration of the cables during operation of the elevator system. If the frequency of the vibrations approaches or enters a natural harmonic of the cables, then the oscillations can be greater than the displacements. In such situations, the cables can tangle with other equipment in the elevator shaft or get structurally weaker over time, and the elevator system may be damaged.

Various conventional methods control the sway of the elevator cables. For example, the method described in Japan Patent JP2033078A a passive damping mechanical system is added to the elevator shaft at one side of the elevator cables where they attach to the elevator shaft. The passive mechanical system applies a brake to the cables motion which reduced their motion and thus reduces their vibration. Similarly in the Japan Patent JP2106586A two passive mechanical systems are added to the elevator cables system to damp out their vibrations. One roller-like mechanical system is mounted at the point of connection between the elevator cables and the elevator shaft with a motion of the rollers along the elevator shaft wall, i.e., perpendicular to the vibration of the elevator cables.

Another similar passive mechanical system is mounted under the elevator car at the point of attachment of the elevator cables and the elevator car. This mechanical system includes a roller-like device forcing the cables to move in the axis of vibrations of the elevator cables. Such a mechanical system allows the two extremities of the elevator cables to move in two perpendicular directions, and the brake applied to the rollers damps out the motion of the elevator cables to reduce its vibrations.

However, the passive damping systems are configured in advanced and, thus, prevents the adjustment of the control in response to the change in the state of the elevator system.

SUMMARY OF THE INVENTION

It is an objective of some embodiments of an invention to provide a system and a method for reducing a sway of an elevator cable configured connected to an elevator car in an elevator system. It is another objective of some embodiments to reduce the sway by cancelling the cable oscillations using an oscillatory motion of the elevator car.

Some embodiments of the invention are based on a realization that vertical motion of the elevator car induces an extra force on the elevator cables that counteracts the cable sway due to external disturbances on the building. For example, in some embodiments, the motion of the elevator car is controlled by causing a main sheave of the elevator system to change a length of the elevator rope of the elevator car. Thus, the sway of the elevator car can be reduced with a minimal number of actuators or even without the usage of any actuators.

For example, a boundary force can be freely applied to the cable boundary by using the elevator car oscillatory motion, which implies a car acceleration, which finally implies a boundary control force on the free boundary of the cable, attached to the elevator car. The acceleration of the elevator car can be determined as function of the cable sway amplitude and cable sway velocity in such a way to inverse the effect of the disturbance on the cable shape and obtain the original static nominal cable shape.

Accordingly, one embodiment discloses a method for controlling an operation of an elevator system including an elevator car moving within an elevator shaft and at least one elevator cable connected to the elevator car and the elevator shaft to carry electrical signals to the elevator car. The method includes determining a counter force on the elevator cable required to change a nominal shape of the elevator cable to an inverse shape of a current shape of the elevator cable caused by disturbance on the elevator system; and applying the counter force to the elevator cable. At least some steps of the method are performed using a processor.

Another embodiment discloses an elevator system including an elevator car supported by an elevator rope wrapped around a sheave, such that a rotation of the sheave changes a length of the elevator rope between the sheave and the elevator car thereby controlling a movement of the elevator car within an elevator shaft of the elevator system; a motor to control a rotation of the sheave changing the length of the elevator rope; at least one elevator cable connected to the elevator car and the elevator shaft; a sway sensor to determine an amplitude and a velocity of a sway of the elevator cable; a controller including a processor to determine a counter force on the elevator cable required to change a nominal shape of the elevator cable to a shape that is inverse of a current shape of the elevator cable caused by disturbance on the elevator system, and to cause the motor to rotate the sheave and to move the elevator car with an acceleration that applies the counter force to the elevator cable.

Yet another embodiment discloses a computer implemented method for controlling an operation of an elevator system including an elevator car moving within an elevator shaft and at least one elevator cable connected to the elevator car and the elevator shaft, wherein the method is implemented using a processor configured to execute a set of instruction stored in a memory. The method includes determining an amplitude and a velocity of a sway of the elevator cable during the operation of the elevator system; determining an acceleration of the elevator car according to a control law as a function of the amplitude and the velocity of the sway; and causing the elevator car to move with the acceleration to stabilize an energy function of dynamics of the elevator cable.

DETAILED DESCRIPTION OF THE PREFERRED EMBODIMENT

Vibration reduction in mechanical systems is important for a number of reasons including safety and efficiency of the systems. Particularly, vibration, such as a lateral sway of an elevator cables in the elevator system, is directly related to the elevator system preservation and to the safety of passengers, and, thus, should be reduced.

Figure 1A:
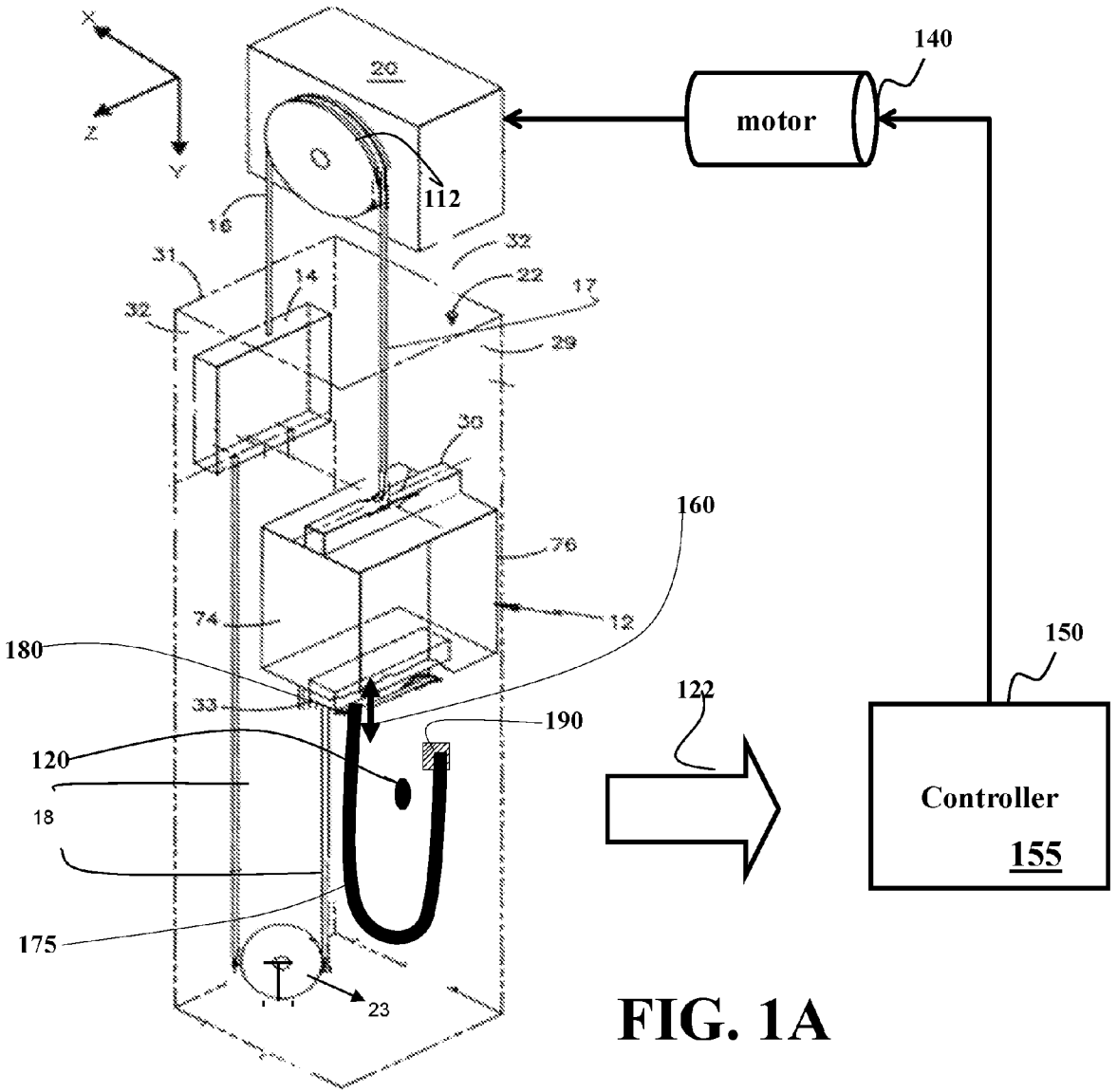
FIG. 1A is a schematic of an elevator system according to one embodiment of an invention.

FIG. 1A shows a schematic of an elevator system according to one embodiment of an invention. The elevator system includes an elevator car 12 connected by at least one elevator ropes to different components of the elevator system. For example, the elevator car and a counterweight 14 connect to one another by main ropes 16-17, and compensating ropes 18. The elevator car 12 can include a crosshead 30 and a safety plank 33. The electrical signals and/or commands are carried to the elevator car by at least one elevator cable 175 connected to the car 12 and the elevator shaft at an attachment point 190.

The elevator car 12 supported by the elevator rope 16 wrapped around a sheave 112. The rotation of the sheave 112 changes a length of the elevator rope between the sheave and the elevator car to control a movement of the elevator car within an elevator shaft of the elevator system. The rotation of the sheave changing the length of the elevator rope can be controlled by a motor connected to the sheave and/or to a pulley 20. The pulley 20 for moving the elevator car 12 and the counterweight 14 through an elevator shaft 22 can be located in a machine room (not shown) at the top (or bottom) of the elevator shaft 22. The elevator system can also include a compensating pulley 23. An elevator shaft 22 includes a front wall 29, a back wall 31, and a pair of side walls 32.

The elevator car and the counterweight have a center of gravity at a point where summations of the moments in the x, y, and z directions are zero. In other words, the elevator car 12 or counterweight 14 can theoretically be supported and balanced at the center of gravity (x, y, z), because all of the moments surrounding the center of gravity point are cancel out. The elevator ropes 16-17 typically are connected to the crosshead 30 of the elevator car 12 where the coordinates of the center of gravity of the car are projected. The elevator ropes 16-17 are connected to the top of the counterweight 14 the coordinates of the center of gravity of the counterweight 14 are projected.

During the operation of the elevator system, different components of the system are subjected to internal and external disturbance, e.g., sway due to wind, resulting in lateral motion of the components. Such lateral motion of the components can result in a sway of the elevator cables 175 that needs to be measured. Accordingly, one or a set of sway sensors 120 are arranged in the elevator system to determine a lateral sway of the elevator cables.

The set of sensors can include at least one sway sensor 120. For example, the sway sensor 120 is configured to sense a lateral sway of the elevator cables at a sway location associated with a position of the sway sensor. However, in various embodiments, the sensors can be arranged in different positions such that the sway locations are sensed and/or measured. The actual positions of the sensors can depend on the type of the sensors used. For example, in one embodiment, a first sway sensor is placed at a neutral position of the cables corresponding to the initial cables configuration, i.e., no cables sway. The other sway sensors are arranged away from the neutral position and at the same height as the first sway sensor.

In various embodiments, the sway sensor 120 is configured to determine amplitude and/or a velocity of a sway of the elevator cable 175. For example, the sway sensor can be any motion sensor, e.g., a light beam sensor, or continuous laser sensors configured to measure the displacement of the elevator cable 175 to determine the amplitude of the sway. Consecutive measurements of the sway sensor can produce the velocity of the sway. The measurements of the sway sensors are determined and transmitted 122 to a controller 150. In such a manner, the amplitude and the velocity of a sway of the elevator cable are either received by the controller from the sway sensor 120 or determined by a processor of the controller from the measurements 122.

Figure 1B:
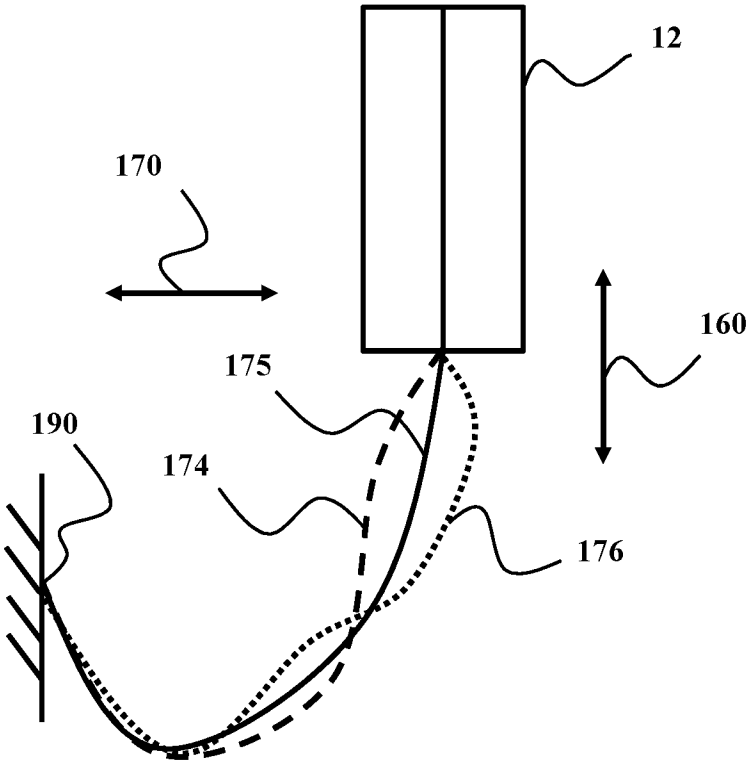
FIG. 1B is a schematic of application of different forces to the elevator cable during the operation of the elevator system according to some embodiments of the invention.

FIG. 1B shows a schematic of application of different forces to the elevator cable 175 during the operation of the elevator system according to some embodiments of the invention. The external disturbances on the building with the elevator system exert a disturbance force 170 on the elevator cable 175. The disturbance force 170 changes the nominal shape of the elevator cable 175 to a current shape 176.

Some embodiments of the invention are based on recognition that it is possible to apply another force on the cable to counteract the effect of the disturbance force on the shape of the elevator cable. In addition, various embodiments of the invention are based on a realization that up and down oscillatory motion of the elevator car can be used to apply such a counter force and to reduce the sway of the elevator cable in an elevator system.

For example, a boundary force can be freely applied to the cable boundary by using the elevator car oscillatory motion, which implies a car acceleration, which finally implies a boundary control force on the free boundary of the cable, attached to the elevator car. The acceleration of the elevator car can be determined as function of the cable sway amplitude and cable sway velocity in such a way to inverse the effect of the disturbance on the cable shape and obtain the original static nominal cable shape.

To that end, the controller 150 includes a processor 155 configured to determine a counter force on the elevator cable required to change a nominal shape of the elevator cable to a shape 174 that is inverse of a current shape 176 of the elevator cable caused by disturbance on the elevator system, and to cause the motor 140 to rotate the sheave 112 and to move 160 the elevator car 12 with an acceleration that applies the counter force to the elevator cable. For example, various embodiments control the main sheave to move the elevator car up and down around the initial static position, within a specified maximum car vertical motion amplitude, e.g., +3 m to −3 m, in such a way to induce enough force on the elevator cables and thus reduce the cables sway.

Some embodiments of the invention are based on a realization that the current shape 176 and the inverse 174 of that current shape depends on a state of the sway of the elevator cable, and thus can be determined indirectly from that state. Specifically, some embodiments determine the inverse shape and/or the counter force required to change the nominal shape of the elevator cable to the shape 174 that is inverse of a current shape 176 of the elevator cable based on the an amplitude and a velocity of a sway of the elevator cable.

Figure 2:
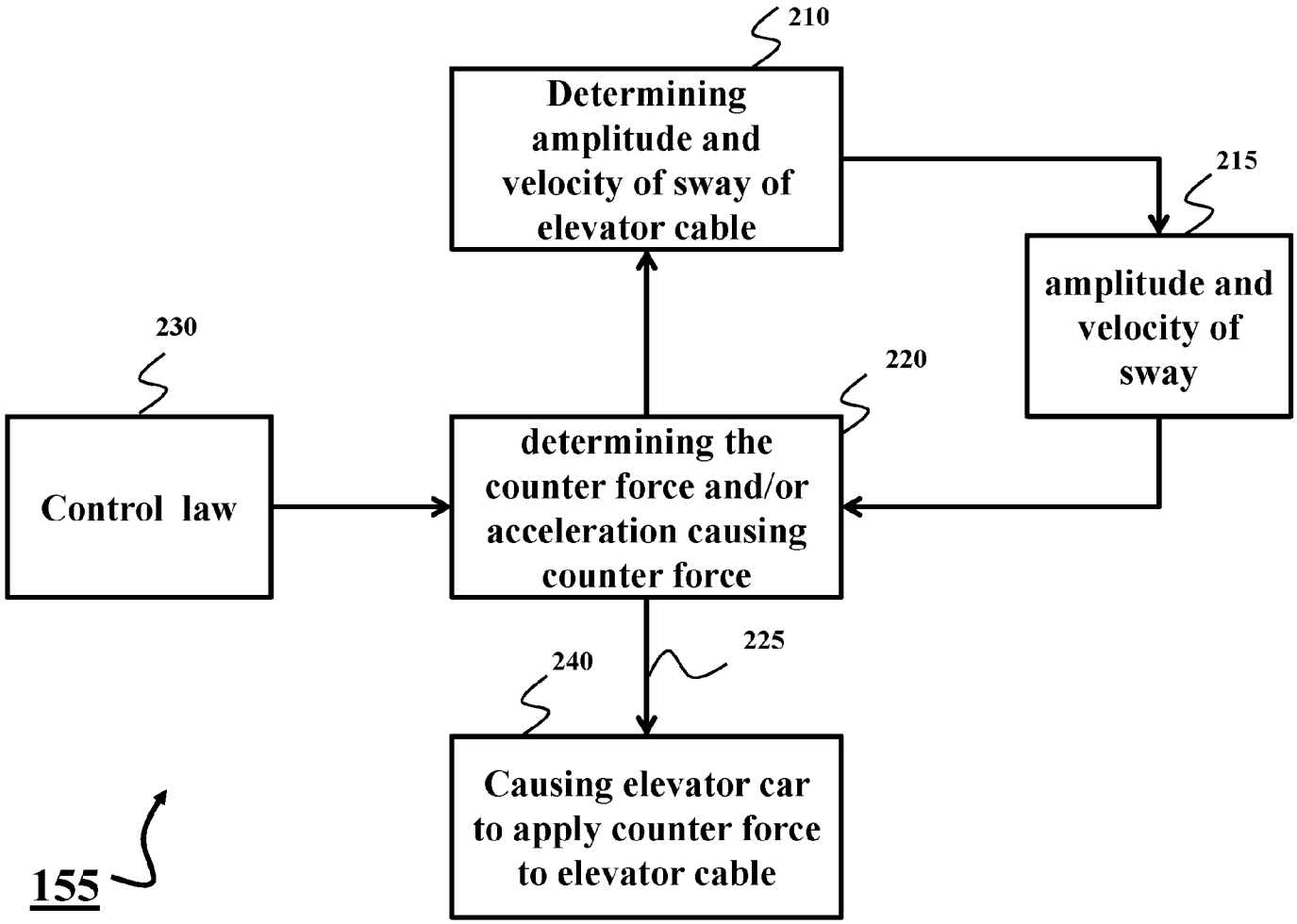
FIG. 2 is a block diagram of a method for determining the counter force applied to the elevator cable according to one embodiment of the invention.

FIG. 2 shows a block diagram of a method for determining the counter force applied to the elevator cable according to one embodiment of the invention. Steps of the method can be implemented by, e.g., a processor 155 of the controller 150.

The method determines 210 an amplitude and a velocity 215 of a sway of the elevator cable caused by the disturbance and determines 220 the counter force 225 according to a control law 230 as a function of the amplitude and the velocity of the sway. The method causes the elevator car to move such as to apply the determined counter force to the elevator cable. In some embodiments, the control law directly produces the acceleration 225 of elevator car required to produce the counter force. In such a manner, the movement of the elevator car induces an extra force in the electrical cable to control the sway of the elevator cable. The control can be a periodic feedback control until, e.g., maximum amplitude of the sway is below a threshold.

In some embodiments, the control law is determined to stabilize an energy function of dynamics of the elevator cable. For example, the energy function is a Lyapunov function along dynamics of the elevator cable, and wherein the control law is determined such that a derivative of the Lyapunov function is negative definite.

For example, some embodiments of the invention are based on a realization that the car motion can generate a force which when applied to the elevator cables can be used to stabilize the cables in the elevator system. Moreover, the stabilization of the elevator cables system can be described by a control Lyapunov function, such that the force induced by the car motion stabilizing the elevator cables system ensures the negative definiteness of a derivative of the control Lyapunov function. By combining Lyapunov theory and the cables damping actuation by car motion, a nonlinear controller, according to some embodiments, reduces the cables sway amplitude. The amplitude and direction of the car motion to be applied are obtained based on the Lyapunov theory.

Those embodiments are based on realization that the inverse shape of the elevator cable can be derived indirectly from a model of the elevator cable attached to the elevator car, using, e.g., Lyapunov control theory.

Figure 3:
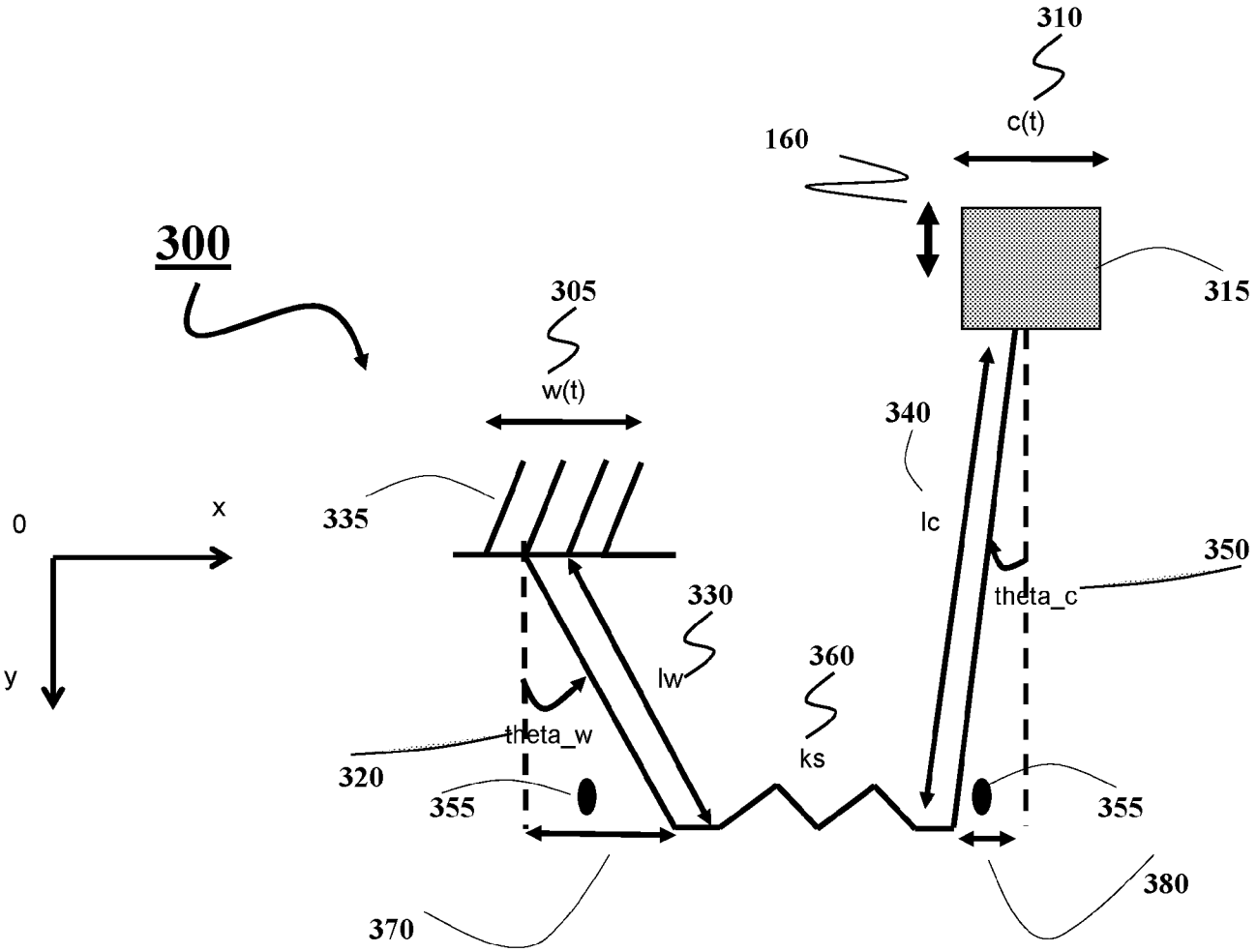
FIG. 3 is an example of a model of a portion of the elevator system including the elevator cable designed based on parameters of the elevator system.

FIG. 3 shows an example of a model 300 of a portion of the elevator system including the elevator cable designed based on parameters of the elevator system. The parameters and the models of other elevator systems can be similarly derived. Various methods can be used to simulate operation of the elevator system according to the model of the elevator system, e.g., to simulate an actual sway 370, 380 of the elevator cable caused by operating the elevator system sensed by a sway sensor 355.

Various embodiments can use different models of the elevator cables system to design the control law. For example, one embodiment performs the modeling based on Newton's law. For example, in one embodiment, the elevator cable is modeled as a two rigid segments 330, 340 coupled with a compliant spring 360. One side of the cables is attached to the car 315, and the other side is attached to the elevator shaft 335. The external disturbance on the system, e.g., from wind, is modeled with w(t)305 at the wall-side and with c(t)310 at the car-side, the cable sways are directly proportional to the angular variable 350 at the car-side, and the angular variable 320 at the wall-side.

This embodiment is advantageous because of its simplicity and low computations requirements. Indeed, other more complicated models might be developed for this system. For instance, embodiment uses a lumped model, which discretized the cables to several small spring-damper elements connected to each other to form a cable and then writes the dynamical models for each element. However, this approach leads to a complicated model with large number of variables, which is not suitable for real-time simulations and control. Another way to design a model for the elevator cable system, is to use an infinite dimension model for each cable, which is mathematically presented in the form of a partial differential equation (PDE). However, solving PDE's online is computationally expensive.

In one embodiment, the model of the elevator cables system controlled with semi-active dampers actuator is determined by an ordinary differential equation (ODE) according to $$m_w l_w^2 \ddot{\theta}_w = -m_w l_w g \sin(\theta_w) - c_w l_w \dot{\theta}_w - F_s l_w \cos(\theta_w) - m_w \ddot{w} l_w \cos(\theta_w);$$

$$m_c l_c^2 \ddot{\theta}_c = -m_c l_c g \sin(\theta_c) - c_c l_c \dot{\theta}_c - F_s l_c \cos(\theta_c) - Uc \sin(\theta_c);$$

$$F_s = k_s(l_c \sin(\theta_c) + l_w \sin(\theta_w)). \quad (1)$$

Parameters of the Equation (1) include $m_c$ (kg) is the mass of the car-side segment of the cable, $l_c$, $l_w$, (m) are the lengths of the car-side segment of the cable, and the wall-side segment, respectively.

$\theta_c$, $\theta_w$ (rad) are the angles of the car-side segment of the cable, and the wall-side segment, respectively.

$\dot{\theta}_c$, $\dot{\theta}_w$ (rad/sec) are the angular velocities of the car-side segment of the cable, and the wall-side segment, respectively.

$\ddot{\theta}_c$, $\ddot{\theta}_w$ (rad/sec$^2$) are the angular accelerations of the car-side segment of the cable, and the wall-side segment, respectively.

$c_c$, $c_w$ (N·sec/m) are the damping coefficients, e.g., laminar flows (air damping coefficient), of the car-side segment of the cable, and the wall-side segment, respectively.

$k_s$, (N/m) is the spring stiffness coefficient of the coupling spring between the car-side segment of the cable and the wall-side segment of the cable, $U_c$ (N) is the control action, and w(t) (m) is the horizontal displacement disturbance at the wall boundary point.

The absolute cables sway is given by $$u_w(y,t) = \tan(\theta_w)y + w(t); \text{ and}$$

$$u_c(y,t) = \tan(\theta_c)y + c(t).$$

wherein: $u_w(y, t)$ is the cables sway at the elevator shaft side and $u_c$ (y, t) is the cables sway at the elevator car side at the vertical position y.

In the case of small angles approximation, the previous model can be re-organized as follows:

$$m_w l_w^2 \ddot{\theta}_w = -m_w l_w g\, \theta_w - c_w l_w \dot{\theta}_w - F_s l_w - m_w \ddot{w} l_w$$

$$m_c l_c^2 \ddot{\theta}_c = -m_c l_c g\, \theta_c - c_c l_c \dot{\theta}_c - F_s l_c - Uc\theta_c$$

$$F_s = k_s(l_c\theta_c + l_w\theta_w) \quad (2)$$

Some embodiments define the matrices:

$$M = \begin{bmatrix} m_w l_w^2 & 0 \\ 0 & m_c l_c^2 \end{bmatrix}, \tag{3}$$

$$K = \begin{bmatrix} k_s l_w^2 + m_w l_w g & k_s l_c l_w \\ k_s l_c l_w & k_s l_c^2 + m_c l_c g \end{bmatrix}. \tag{4}$$

Some embodiments define the Lyapunov function:

$$V = \frac{1}{2}[\dot{\theta}_w \dot{\theta}_c] M [\dot{\theta}_w \dot{\theta}_c]^T + \frac{1}{2}[\dot{\theta}_w \dot{\theta}_c] K [\dot{\theta}_w \dot{\theta}_c]^T. \tag{5}$$

The system model given above is an example of model of the elevator cables system. Other models based on a different theory, e.g., string or beam theory, can be used by the embodiments of the invention.

Updating Movement of the Elevator Car to Stabilize the Cable Sway

Figure 4A:
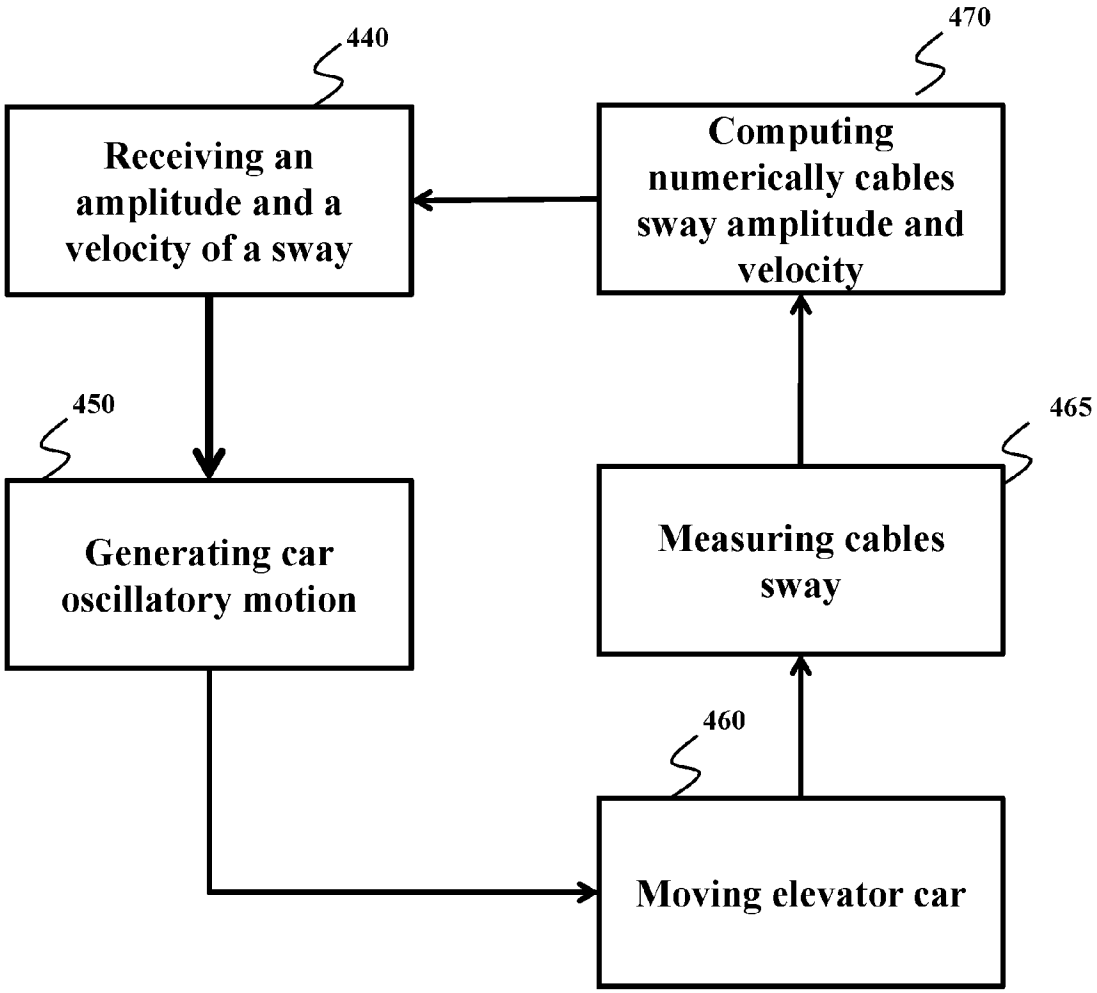
FIG. 4A is a block diagram of a method for controlling an operation of an elevator cables system according to some embodiments of the invention.

FIG. 4A shows a block diagram of a method for controlling an operation of an elevator cables system according to some embodiments of the invention. Various embodiments of the invention determine 450 oscillatory motion for the elevator car and move 460 the elevator car connected to the elevator cable with the oscillatory motion in response to the receiving 440 of a velocity and amplitude of a sway of the elevator cables determined 470 during the operation of the elevator cables system from the measurements 465 of the amplitude of a sway of the cables.

Some embodiments determine the control law to control the elevator car motion to stabilize the cable sway. One embodiment determines the control law for the case of the cables model described above. However, other embodiments similarly determine the control law for any other model of the elevator cables.

Figure 4B:
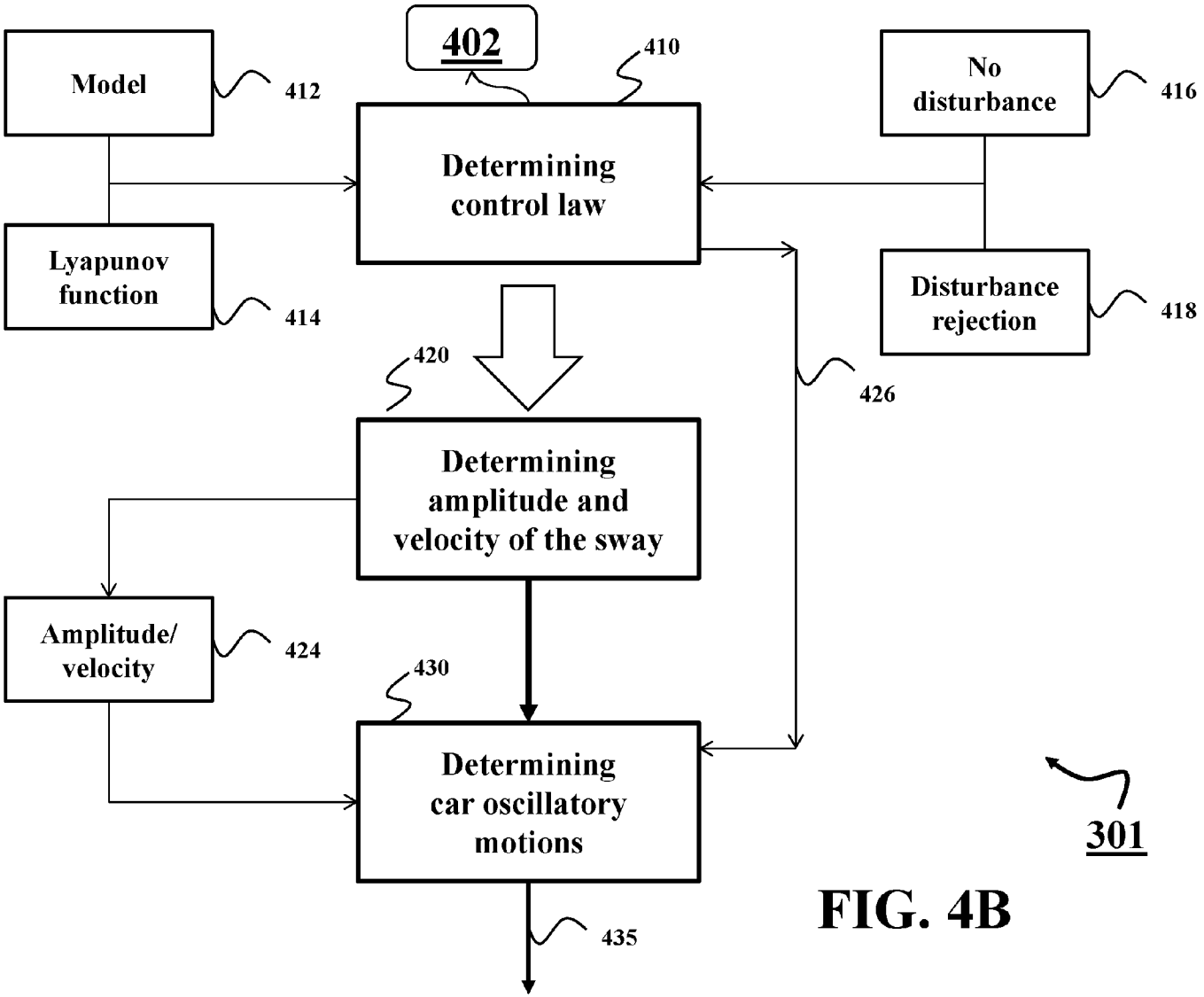
FIG. 4B is a block diagram of a method for controlling an operation of an elevator cables system according to some embodiments of the invention.

FIG. 4B shows a block diagram of a method for controlling an operation of an elevator cables system. The method can be implemented using a processor 401. The method determines 410 a control law 426 stabilizing a sway of the elevator cable using oscillatory motion 435 of the elevator car in the elevator system. The control law is a function of a velocity and amplitude 424 of the sway of the elevator cable, and determined such that a derivative of a Lyapunov function 414 along dynamics of the elevator cables system controlled by the control law is negative definite. The control law can be stored into a memory 402. The memory 402 can be of any type and can be operatively connected to the processor 401 and/or the processor 155.

The negative definiteness requirement of the Lyapunov function ensures the stabilization of the elevator cables system and reduction of the cables sway. Also, determining the control based on Lyapunov theory allows applying the car motion optimally, i.e., only when necessary to reduce the sway, and thus reduce the maintenance cost of the elevator system and the overall energy consumption.

One embodiment determines the control law 426 based on a model 412 of the elevator system with no disturbance 416. The disturbance include external disturbance such as a force of the wind or seismic activity. This embodiment is advantageous when the external disturbance is small or quickly dissipated. However, such embodiment can be suboptimal when the disturbance is large and steady.

Another embodiment modifies the control law with a disturbance rejection component 418 to force the derivative of the Lyapunov function to be negative definite. This embodiment is advantageous for elevator systems subject to a long term disturbance. In one variation of this embodiment, the external disturbance is measured during the operation of the elevator system. In another embodiment, the disturbance rejection component is determined based on the boundaries of the external disturbance. This embodiment allows for compensating for disturbance without measuring the disturbance.

During the operation of the elevator system, the method determines 420 the amplitude and the velocity 424 of the sway of the elevator cables. For example, the amplitude and the velocity can be directly measured using various samples of the state of the elevator system. Additionally or alternatively, the amplitude and the velocity of the sway can be estimated using, e.g., a model of the elevator cables system and reduce number of samples, or various interpolation techniques.

Next, the car motion 435 applied to the elevator cables is determined based on the control law 426, and the velocity 424 and amplitude 420 of the sway of the elevator cables.

In some embodiments, the control law produces oscillating values of the acceleration in response to a change of a sign of a product of the amplitude and the velocity of the sway of the elevator cable. In such a manner the oscillation motion of the elevator car is ensured. Also, in one embodiment, the control law includes a positive gain bounding an absolute value of the acceleration. This embodiment ensures feasibility of the oscillation motion of the elevator car.

By combining the Lyapunov theory and the car motion, the control unit 150, according to some embodiments, reduces the amplitude of the cables sway by using a sway dependent nonlinear control amplitude which decreases as function of the cables sway velocity and amplitude. The amplitude and direction of car motion, to be applied is obtained based on the Lyapunov theory.

One embodiment defines a control Lyapunov function V(X) as $$V = \frac{1}{2}\dot{X}^T M \dot{X} + \frac{1}{2}\dot{X}^T K X$$

wherein M, K, and X are the mass, stiffness matrices of the cable system and the vector of angular displacements, as defined above, and where $X=[\theta_w \theta_c]^T$.

Some embodiments, determines the control law such that a derivative of the Lyapunov function along dynamics of the elevator cables system controlled by the control law is negative definite. One embodiment determines the derivative of the Lyapunov function along the dynamics of the elevator cables system, according to $$\dot{V} = -c_w l_w \ddot{\theta}_w^2 - c_c l_c \dot{\theta}_c^2 - m_w \ddot{w} l_w \dot{\theta}_w - Uc\theta_c \dot{\theta}_c, \tag{6}$$

$$\dot{V} \le -m_w \ddot{w} l_w \dot{\theta}_w - Uc\theta_c \dot{\theta}_c. \tag{7}$$

wherein the coefficients are as defined in the elevator cables systems presented above.

To ensure the negative definiteness of the derivative $\dot{V}$, the control law 426 according to one embodiment determines 430 the acceleration of the elevator car according to $$Uc = k_c \frac{\theta_c \dot{\theta}_c |\dot{\theta}_\omega|}{\sqrt{1 + \theta_c^2 \dot{\theta}_c^2 \dot{\theta}_\omega^2}}, \; k_c > 0 \tag{8}$$

wherein $k_c$, is a positive tuning gain, $\theta_c$ is the angular sway amplitude at the car side, $\theta_w$ is the angular sway amplitude at the wall side, $\dot{\theta}_c$ is the angular sway velocity at the car side, and $\dot{\theta}_w$ is the angular sway velocity at the wall side.

This control law is a nonlinear function of the cables angular velocity and amplitudes, which means its amplitude decreases as function of the cables sway velocities and amplitudes. Furthermore the maximum value of the control law, which means the maximum value of the car acceleration are fixed by the positive constant $k_c$. A controller according to the previous control law stabilizes the elevator cables system with no disturbance by varying the car motion 160 as a nonlinear function of the cables angular velocities and amplitudes. This controller is advantageous when the disturbance is unknown or minimal.

Additionally or alternatively, for situations with non-zero disturbances, one embodiment uses the control law 426 according to $$\dot{V} \leq \left( -k_c \frac{\theta_c^2 \dot{\theta}_c^2}{\sqrt{1 + \theta_c^2 \dot{\theta}_c^2 \dot{\theta}_\omega^2}} + m_\omega |\dot{\omega}|_{max} l_\omega \right) |\dot{\theta}_w| \tag{9}$$

The convergence of the state vector X to the invariant set $$S = \left\{ X \in R^4, \text{ s.t. } -k_c \frac{\theta_c^2 \dot{\theta}_c^2}{\sqrt{1 + \theta_c^2 \dot{\theta}_c^2 \dot{\theta}_\omega^2}} + m_\omega |\dot{\omega}|_{max} l_\omega \geq 0 \right\},$$

wherein Uc is multiplied by $\sin(\theta_c)$ which limits the effect of the torque Uc when the angle $\theta_c$ is small.

The above-described embodiments can be implemented in any of numerous ways. For example, the embodiments may be implemented using hardware, software or a combination thereof. When implemented in software, the software code can be stored on a non-transient computer readable memory and executed on any suitable processor or collection of processors, whether provided in a single computer or distributed among multiple computers. Such processors may be implemented as integrated circuits, with one or more processors in an integrated circuit component. Though, a processor may be implemented using circuitry in any suitable format.

Computer-executable instructions may be in many forms, such as program modules, executed by one or more computers or other devices. Generally, program modules include routines, programs, objects, components, and data structures that perform particular tasks or implement particular abstract data types. Typically the functionality of the program modules may be combined or distributed as desired in various embodiments.

Also, the embodiments of the invention may be embodied as a method, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

Although the invention has been described by way of examples of preferred embodiments, it is to be understood that various other adaptations and modifications can be made within the spirit and scope of the invention. Therefore, it is the object of the appended claims to cover all such variations and modifications as come within the true spirit and scope of the invention.

We claim:

1. A method for controlling an operation of an elevator system including an elevator car moving within an elevator shaft and an elevator cable connected to the elevator car and the elevator shaft to carry electrical signals to the elevator car, comprising:

measuring an amplitude and a velocity of a sway of the elevator cable caused by disturbance on the elevator system;

determining a counter force on the elevator cable required to change a nominal shape of the elevator cable to an inverse shape of a current shape of the elevator cable caused by the disturbance on the elevator system, wherein the counter force is determined according to a control law as a function of the amplitude and the velocity of the sway, wherein the control law is determined to stabilize an energy function of dynamics of the elevator cable to produce a value of an acceleration Uc of the elevator car resulting in application of the counter force to the elevator cable, wherein the control law includes $$Uc = k_c \frac{\theta_c \dot{\theta}_c |\dot{\theta}_\omega|}{\sqrt{1 + \theta_c^2 \dot{\theta}_c^2 \dot{\theta}_\omega^2}}, \; k_c > 0$$

wherein $k_c$, is a positive tuning gain, $\theta_c$ is an angular sway amplitude of the elevator cable in proximity to the elevator car, $\theta_w$ is an angular sway amplitude of the elevator cable in proximity to a wall of the elevator shaft, $\dot{\theta}_c$ is an angular sway velocity of the elevator cable in proximity to the elevator car, and $\dot{\theta}_w$ is an angular sway velocity in proximity to the wall of the elevator shaft; and applying the counter force to the elevator cable by moving the elevator car with the acceleration having the value produced by the control law, wherein at least some steps of the method are performed using a processor.

2. The method of claim 1, wherein the energy function is a Lyapunov function along dynamics of the elevator cable, and wherein the control law is determined such that a derivative of the Lyapunov function is negative definite.

3. The method of claim 1, wherein the control law produces oscillating values of the acceleration in response to a change of a sign of a product of the amplitude and the velocity of the sway of the elevator cable.

4. The method of claim 1, wherein the control law includes a positive gain bounding an absolute value of the acceleration.

5. An elevator system comprising:

an elevator car supported by an elevator rope wrapped around a sheave, such that a rotation of the sheave changes a length of the elevator rope between the sheave and the elevator car thereby controlling a movement of the elevator car within an elevator shaft of the elevator system;

a motor to control a rotation of the sheave changing the length of the elevator rope;

an elevator cable connected to the elevator car and the elevator shaft;

a sway sensor to determine an amplitude and a velocity of a sway of the elevator cable;

a controller including a processor to determine a counter force on the elevator cable required to change a nominal shape of the elevator cable to a shape that is inverse of a current shape of the elevator cable caused by disturbance on the elevator system, and to cause the motor to rotate the sheave and to move the elevator car with an acceleration that applies the counter force to the elevator cable, wherein the processor determines the acceleration according to a control law as a function of the amplitude and the velocity of the sway, wherein the control law is determined to stabilize an energy function of dynamics of the elevator cable, wherein the control law includes $$Uc = k_c \frac{\theta_c \dot{\theta}_c |\dot{\theta}_\omega|}{\sqrt{1 + \theta_c^2 \dot{\theta}_c^2 \dot{\theta}_\omega^2}}, \; k_c > 0$$

wherein $k_c$, is a positive tuning gain, $\theta_c$ is an angular sway amplitude of the elevator cable in proximity to the elevator car, $\theta_w$ is an angular sway amplitude of the elevator cable in proximity to a wall of the elevator shaft, $\dot{\theta}_c$ is an angular sway velocity of the elevator cable in proximity to the elevator car, and $\dot{\theta}_w$ is an angular sway velocity in proximity to the wall of the elevator shaft.

6. The elevator system of claim 5, wherein the energy function is a Lyapunov function along dynamics of the elevator cable, and wherein the control law is determined such that a derivative of the Lyapunov function is negative definite.

7. The elevator system of claim 5, wherein the control law produces oscillating values of the acceleration in response to a change of a sign of a product of the amplitude and the velocity of the sway of the elevator cable.

8. The elevator system of claim 7, wherein the control law includes a positive gain bounding an absolute value of the acceleration.

9. A computer implemented method for controlling an operation of an elevator system including an elevator car moving within an elevator shaft and an elevator cable connected to the elevator car and the elevator shaft, wherein the method is implemented using a processor configured to execute a set of instruction stored in a memory, the method comprising:

determining an amplitude and a velocity of a sway of the elevator cable during the operation of the elevator system;

determining an acceleration of the elevator car according to a control law as a function of the amplitude and the velocity of the sway, wherein the control law includes $$Uc = k_c \frac{\theta_c \dot{\theta}_c |\dot{\theta}_\omega|}{\sqrt{1 + \theta_c^2 \dot{\theta}_c^2 \dot{\theta}_\omega^2}}, \; k_c > 0$$

wherein $k_c$, is a positive tuning gain, $\theta_c$ is an angular sway amplitude of the elevator cable in proximity to the elevator car, $\theta_w$ is an angular sway amplitude of the elevator cable in proximity to a wall of the elevator shaft, $\dot{\theta}_c$ is an angular sway velocity of the elevator cable in proximity to the elevator car, $\dot{\theta}_w$ and is an angular sway velocity in proximity to the wall of the elevator shaft; and causing the elevator car to move with the acceleration to stabilize an energy function of dynamics of the elevator cable.

* * * * *